US006581528B2

(12) United States Patent
Tseng

(10) Patent No.: US 6,581,528 B2
(45) Date of Patent: Jun. 24, 2003

(54) TABLE WITH TELESCOPIC LEG UNIT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 57 days.

(21) Appl. No.: 10/045,201

(22) Filed: Nov. 9, 2001

(65) Prior Publication Data

US 2003/0089287 A1 May 15, 2003

(51) Int. Cl.[7] ..... A47B 9/20
(52) U.S. Cl. ..... 108/147.19; 108/148; 248/188.5
(58) Field of Search ..... 108/147.19, 147.2, 108/147.21, 148, 144.11, 146; 248/188.5, 125.8, 407, 161, 414, 413, 423

(56) References Cited

U.S. PATENT DOCUMENTS 1,394,596 A * 10/1921 Wohl et al.
3,453,011 A * 7/1969 Neinunger
3,701,506 A * 10/1972 Favreau
4,185,936 A * 1/1980 Takahashi
4,667,605 A * 5/1987 Bastian
4,818,135 A * 4/1989 Desjardins
5,039,043 A * 8/1991 Hodge
5,423,502 A * 6/1995 Thomason et al.
5,513,825 A * 5/1996 Gutgsell
6,186,463 B1 * 2/2001 Williams et al.

FOREIGN PATENT DOCUMENTS

DE 3604497 A1 * 8/1987

* cited by examiner

*Primary Examiner*—Jose V. Chen
(74) *Attorney, Agent, or Firm*—Ladas & Parry

(57) ABSTRACT

A table includes a telescopic leg unit and a positioning mechanism. The telescopic leg unit includes an inner leg post, a tubular outer leg post and a resilient tubular bushing. The positioning mechanism includes a press member, a support member, and an operating lever. The press member is movable in radial inward and radial outward directions relative to the leg unit. The support member is mounted securely on the outer leg post and is formed with a lever coupling hole that is aligned with the press member in a radial direction relative to the leg unit. The operating lever is operable so as to force the press member to move in the radial inward direction and abut against the tubular bushing, thereby enabling the tubular bushing to frictionally engage the inner leg post so as to resist movement of the inner leg post relative to the outer leg post.

11 Claims, 4 Drawing Sheets

TABLE WITH TELESCOPIC LEG UNIT

BACKGROUND OF THE INVENTION

1. Field of the Invention

The invention relates to a table, more particularly to a table with a telescopic leg unit that facilitates height adjustment of a table top thereon.

2. Description of the Related Art

A table with a telescopic leg unit for adjusting the height of a table top is known in the art. Various positioning mechanisms have been devised to enable the telescopic leg unit to position the table top at the desired height. However, the conventional positioning mechanisms have numerous shortcomings, such as complex structures and inconvenient operation. Therefore, there remains a constant need to develop a table with an improved telescopic leg unit.

SUMMARY OF THE INVENTION

The object of the present invention is to provide a table with a telescopic leg unit and a positioning mechanism that is relatively simple in construction and that is easy to operate.

Accordingly, the table of this invention includes a table top and a table leg assembly coupled to the table top for supporting the table top above a ground surface. The table leg assembly includes a base adapted to be placed on the ground surface, a telescopic leg unit, and a positioning mechanism.

The telescopic leg unit includes an inner leg post, a tubular outer leg post and a resilient tubular bushing. The inner leg post has an upper post section coupled to the table top, and a lower post section. The tubular outer leg post has a lower section coupled to the base, and an upper section through which the lower post section of the inner leg post slidably extends. The upper section of the outer leg post is formed with a radial access opening. The resilient tubular bushing is mounted in the upper section of the outer leg post and is disposed to surround the lower post section of the inner leg post. The tubular bushing is accessible via the access opening.

The positioning mechanism includes a press member, a support member, and an operating lever. The press member is disposed in the access opening and is movable in radial inward and radial outward directions relative to the leg unit. The support member is mounted securely on the outer leg post and is formed with a lever coupling hole that is aligned with the press member in a radial direction relative to the leg unit. The operating lever has a threaded portion that engages the support member in the lever coupling hole. The operating lever is operable so as to force the press member to move in the radial inward direction and abut against the tubular bushing, thereby enabling the tubular bushing to frictionally engage the inner leg post so as to resist movement of the inner leg post relative to the outer leg post.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
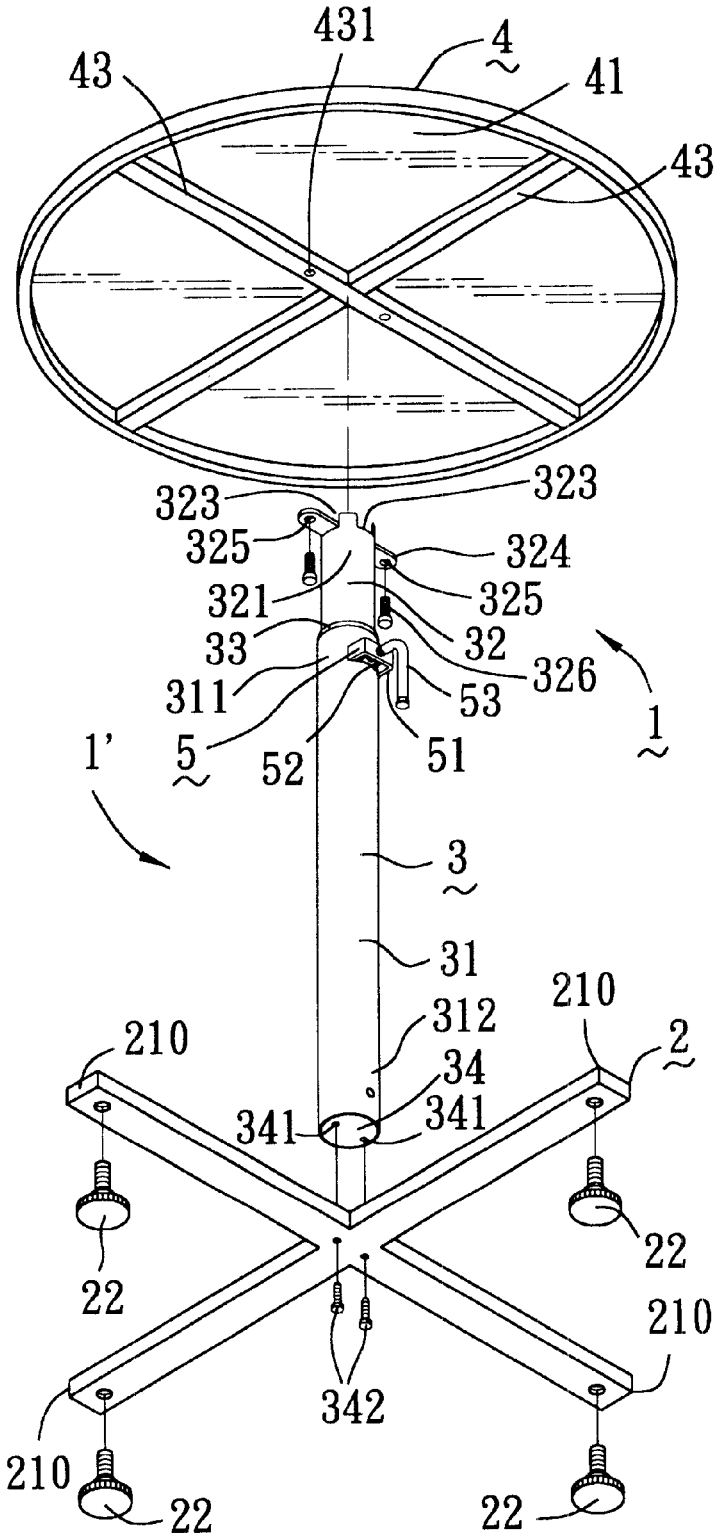
FIG. 1 is an exploded perspective view of the preferred embodiment of a table with a telescopic leg unit according to this invention.
Figure 2:
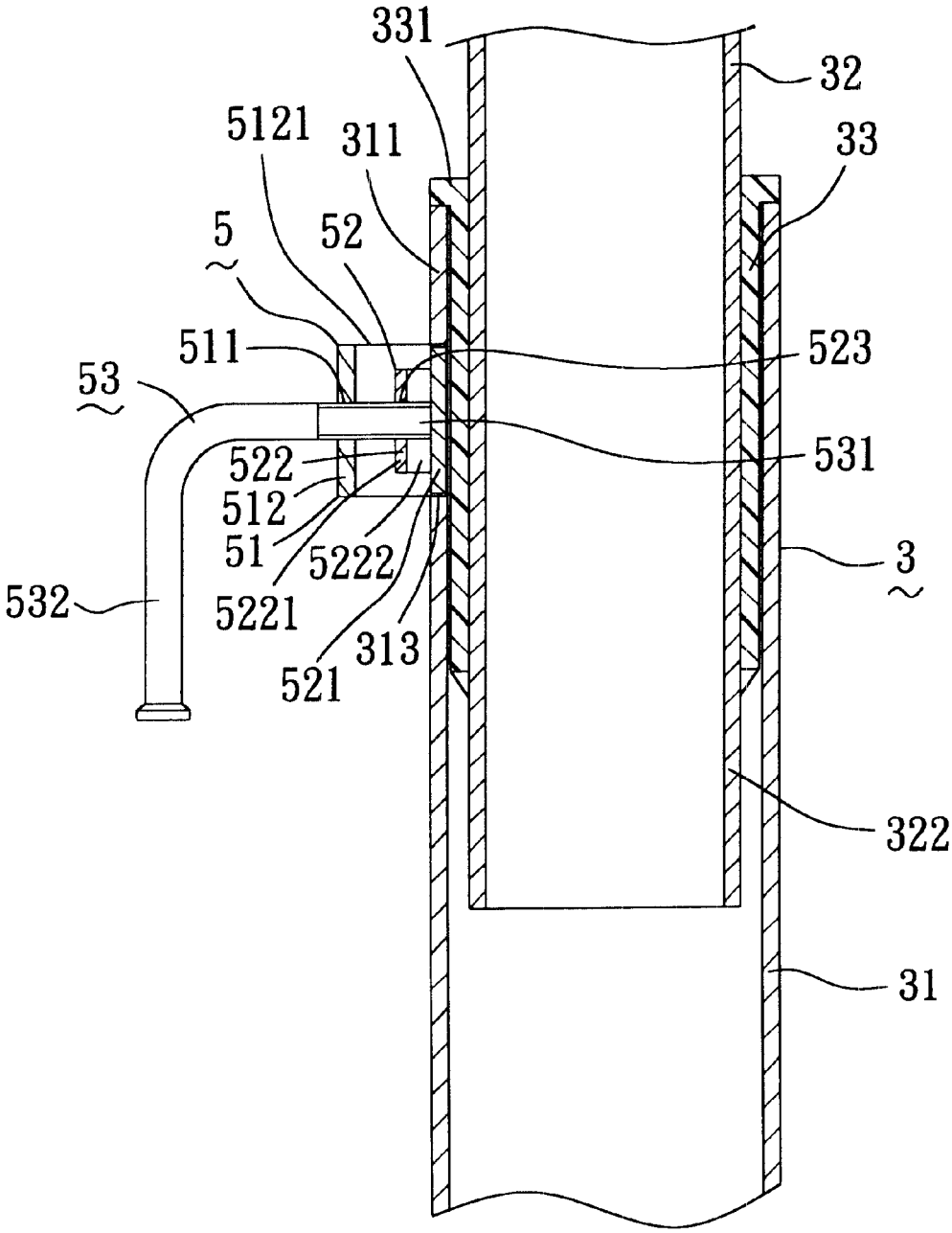
FIG. 2 is a fragmentary sectional view of a table leg assembly of the preferred embodiment.

Referring to FIG. 1, the preferred embodiment of a table 1 with a telescopic leg unit 3 according to this invention is shown to include a table top 4 and a table leg assembly l' coupled to the table top 4 for supporting the table top 4 above a ground surface. The table leg assembly 1' includes a base 2 adapted to be placed on the ground surface, a telescopic leg unit 3, and a positioning mechanism 5. Referring to FIGS. 1 and 2, the telescopic leg unit 3 includes an inner leg post 32, a tubular outer leg post 31 and a resilient tubular bushing 33. The inner leg post 32 has an upper post section 321 coupled to the table top 4, and a lower post section 322. The tubular outer leg post 31 has a lower section 312 coupled to the base 2, and an upper section 311 through which the lower post section 322 of the inner leg post 32 slidably extends. The upper section 311 of the outer leg post 31 is formed with a radial access opening 313. The resilient tubular bushing 33 is mounted in the upper section 311 of the outer leg post 31 and is disposed to surround the lower post section 322 of the inner leg post 32. The tubular bushing 33, which is made of a resilient material such as plastic or rubber, is accessible via the access opening 313. Preferably, the tubular bushing 33 has a top part that extends outwardly of the upper section 311 of the outer leg post 31 and that is formed with a top end flange 331 seated on a distal top end face of the upper section 311 of the outer leg post 31.

Figure 3:
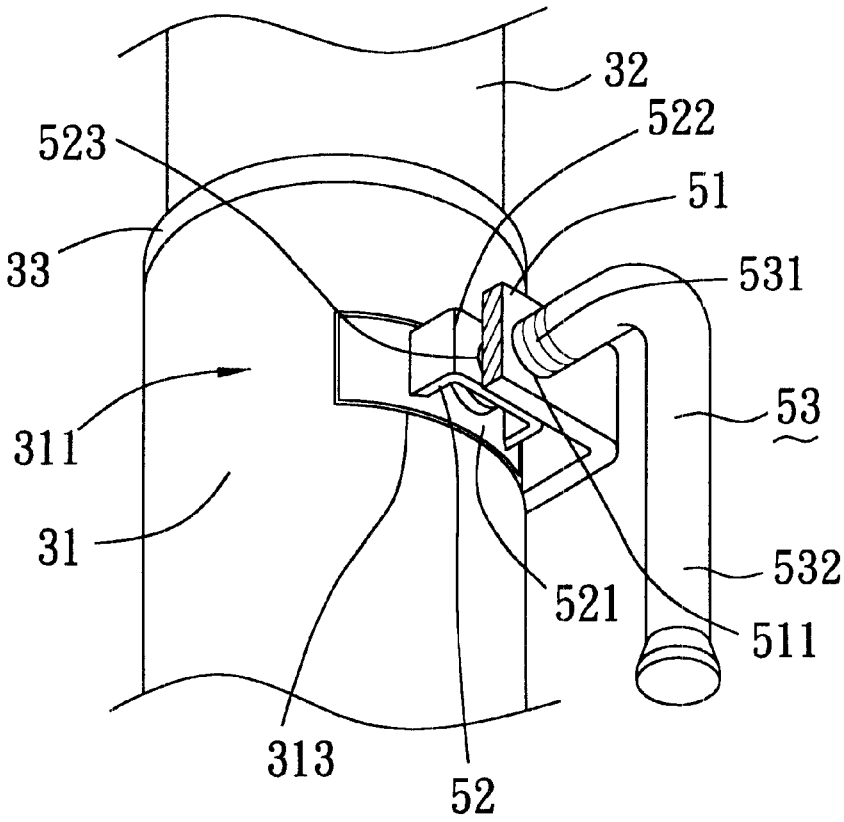
FIG. 3 is a fragmentary perspective view of the table leg assembly of FIG. 2.

Referring to FIGS. 1, 2 and 3, the positioning mechanism 5 includes a press member 52, a support member 51, and an operating lever 53. The press member 52 is disposed in the access opening 313 and is movable in radial inward and radial outward directions relative to the leg unit 3. The support member 51 is mounted securely on the outer leg post 31 and is formed with a lever coupling hole 511 that is aligned with the press member 52 in a radial direction relative to the leg unit 3. The operating lever 53 has a threaded portion 531 that engages the support member 51 in the lever coupling hole 511. The operating lever 53 is operable so as to force the press member 52 to move in the radial inward direction and abut against the tubular bushing 33, thereby enabling the tubular bushing 33 to frictionally engage the inner leg post 32 so as to resist movement of the inner leg post 32 relative to the outer leg post 31, as shown in FIG. 5.

Figure 4:
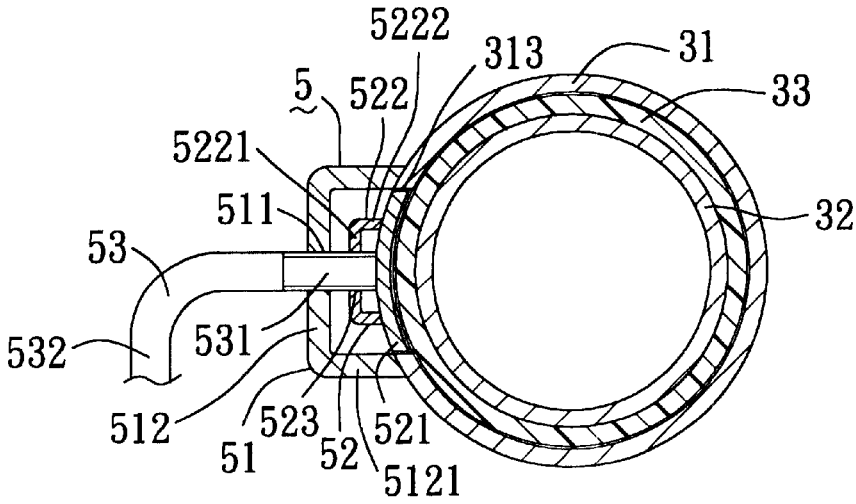
FIG. 4 is a top sectional view of the table leg assembly of FIG. 2 showing a state where a press member is not forced to abut against a tubular bushing.
Figure 5:
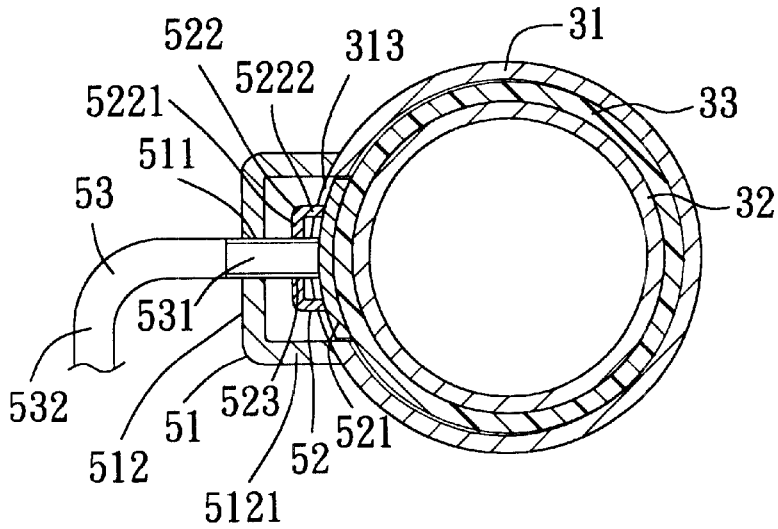
FIG. 5 is a top sectional view of the table leg assembly of FIG. 2 showing a state where the press member is forced to abut against the tubular bushing.

Referring to FIGS. 2, 4 and 5, the press member 52 includes a press plate 521 disposed in the access opening 313 and confronting the tubular bushing 33, and a U-shaped bracket 522 having a lever engaging plate 5221 spaced apart from the press plate 521 in the radial direction relative to the leg unit 3 and formed with a lever engaging hole 523, and a pair of connecting plates 5222 that interconnect the lever engaging plate 5221 and the press plate 521. The threaded portion 531 of the operating lever 53 engages the lever engaging plate 5221 in the lever engaging hole 523. The support member 51 is generally U-shaped, and includes a lever coupling plate 512 that is spaced apart from the outer leg post 31 in the radial direction relative to the leg unit 3, that spans the access opening 313, and that is formed with the lever coupling hole 511, and a pair of connecting plates 5121 that interconnect the lever coupling plate 512 and the outer leg post 31. The operating lever 53 is generally L-shaped and further has an operating portion 532 that is transverse to the threaded portion 531.

Referring again to FIG. 1, the table top 4 includes a lower cross-shaped support 43, and an upper panel member 41 disposed on the top of the support 43. The inner leg post 32 is tubular. The upper post section 321 of the inner leg post 32 has a distal top edge formed with four angularly spaced apart notches 323 for engaging the support 43. Furthermore, the distal top edge of the upper post section 321 of the inner leg post 32 is formed with a pair of radial outward lug projections 324, each having a hole 325 in an end thereof. The leg unit 3 further includes fasteners 326 that extend through the holes 325 to engage holes 431 in the support 43, thereby fastening the lug projections 324 onto the support 43.

Additionally, the lower section 312 of the outer leg post 31 has a connecting block 34 fitted therein. The leg unit 3 further includes a fastener set 341, 342 for fastening the base 2 to the connecting block 34. Preferably, a plurality of adjustable foot units 22 are mounted on the base 2 so as to adjust the level of the table top 4. In this embodiment, the base 2 is generally cross-shaped, and the foot units 22 are mounted threadedly and respectively at four ends 210 of the base 2.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A table comprising a table top and a table leg assembly coupled to said table top for supporting said table top above a ground surface, said table leg assembly including:

a base adapted to be placed on the ground surface;

a telescopic leg unit including an inner leg post having an upper post section coupled to said table top, and a lower post section, a tubular outer leg post having a lower section coupled to said base, and an upper section through which said lower post section of said inner leg post slidably extends, said upper section of said outer leg post being formed with a radial access opening, and a resilient tubular bushing mounted in said upper section of said outer leg post and disposed to surround said lower post section of said inner leg post, said tubular bushing being accessible via said access opening; and a positioning mechanism including a press member disposed in said access opening and movable in radial inward and radial outward directions relative to said leg unit, a support member mounted securely on said outer leg post and formed with a lever coupling hole that is aligned with said press member in a radial direction relative to said leg unit, and an operating lever having a threaded portion that engages said support member in said lever coupling hole, said operating lever being operable so as to force said press member to move in the radial inward direction and abut against said tubular bushing, thereby enabling said tubular bushing to frictionally engage said inner leg post so as to resist movement of said inner leg post relative to said outer leg post.

2. The table of claim 1, wherein said press member includes a press plate disposed in said access opening and confronting said tubular bushing, and a bracket having a lever engaging plate spaced apart from said press plate in the radial direction relative to said leg unit and formed with a lever engaging hole, and at least a connecting plate that interconnects said lever engaging plate and said press plate, said threaded portion of said operating lever engaging said lever engaging plate in said lever engaging hole.

3. The table of claim 2, wherein said support member includes a lever coupling plate that is spaced apart from said outer leg post in the radial direction relative to said leg unit, that spans said access opening, and that is formed with said lever coupling hole, and at least a connecting plate that interconnects said lever coupling plate and said outer leg post.

4. The table of claim 1, wherein said operating lever is generally L-shaped and further has an operating portion that is transverse to said threaded portion.

5. The table of claim 1, wherein said tubular bushing has a top part that extends outwardly of said upper section of said outer leg post and that is formed with a top end flange seated on a distal top end face of said upper section of said outer leg post.

6. The table of claim 1, wherein:

said table top includes a lower cross-shaped support, and an upper panel member disposed on said top of said support;

said inner leg post being tubular, said upper post section of said inner leg post having a distal top edge formed with four angularly spaced apart notches for engaging said support.

7. The table of claim 6, wherein said distal top edge of said upper post section of said inner leg post is further formed with at least one radial outward lug projection, said leg unit further including at least one fastener for fastening said lug projection onto said support.

8. The table of claim 1, wherein said lower section of said outer leg post has a connecting block fitted therein, said leg unit further including a fastener set for fastening said base to said connecting block.

9. The table of claim 8, wherein said base is generally cross-shaped.

10. The table of claim 1, further comprising a plurality of adjustable foot units mounted on said base.

11. The table of claim 10, wherein said base is generally cross-shaped, and said foot units are mounted threadedly and respectively at four ends of said base.

* * * * *